United States Patent [19]

Crothers

[11] Patent Number: 4,637,188

[45] Date of Patent: Jan. 20, 1987

[54] SPLICING MEANS FOR FACED INSULATION BATTS

[75] Inventor: Steven D. Crothers, Newark, Ohio

[73] Assignee: Owens-Corning Fiberglas Corporation, Toledo, Ohio

[21] Appl. No.: 834,725

[22] Filed: Feb. 28, 1986

[51] Int. Cl.[4] ..... E04B 1/74

[52] U.S. Cl. ..... 52/404; 52/407; 52/743

[58] Field of Search ..... 52/404, 407, 743, 359

[56] References Cited

U.S. PATENT DOCUMENTS

| | | | |
|---|---|---|---|
| 3,186,526 | 6/1965 | Sidener | 52/404 |
| 3,398,496 | 8/1968 | Mischke | 52/463 |
| 3,553,915 | 1/1971 | Passovoy | 52/359 X |
| 4,172,345 | 10/1979 | Alderman | 52/743 X |
| 4,391,075 | 7/1983 | Musgrave | 52/484 X |
| 4,446,665 | 5/1984 | Berger | 52/407 |
| 4,528,790 | 7/1985 | Lo et al. | 52/484 X |

*Primary Examiner*—Alfred C. Perham

*Attorney, Agent, or Firm*—Ronald C. Hudgens; Ted C. Gillespie; Paul J. Rose

[57] ABSTRACT

The splicing means includes a push-on sheet metal splicing member for mounting on an upper flange portion of an I-beam and presenting a vertically oriented backing portion for a pair of clamping strips securable respectively to opposite sides of the backing portion by self-tapping screws.

2 Claims, 5 Drawing Figures

SPLICING MEANS FOR FACED INSULATION BATTS

TECHNICAL FIELD

This invention relates generally to faced insulation for ceilings of metal buildings, and more particularly to splicing means for faced insulation batts installed as insulation and ceiling finish in metal buildings.

BACKGROUND ART

U.S. Pat. No. 4,528,790 discloses a roof/ceiling insulation system wherein insulation supporting tubes are suspended from and extend parallel to the purlins or auxiliary support beams, and faced fibrous insulation batts are strung over the tubes perpendicularly to the purlins in each bay defined by a pair of adjacent main support beams. This system requires a tedious special operation for insulating over the main support beam between each bay. A vapor barrier, preferably a plastic film, has to be strung over each section of a main support beam between two adjacent purlins, and then stapled to the facing of the adjacent faced insulation batts strung over the tubes on opposite sides of the main support beam, as shown in FIG. 6 of U.S. Pat. No. 4,391,075. Insulation then has to be placed on top of the plastic film running over the main support beam. Further, many items such as lights, rods, pipes, support hooks, etc. are often hung from the purlins. Whenever these items don't happen to be located between insulation strips, the faced insulation has to be cut.

DISCLOSURE OF INVENTION

In accordance with the invention, a roof or ceiling insulation system is disclosed wherein insulation supporting tubes are suspended to run perpendicularly to the purlins and parallel to the main beams. Because the tubes are not interrupted by the main beams, they can be connected to extend all the way across one dimension of a building. The faced insulation batts or strips can then be strung over the tubes and main beams, and any items hung from the purlins can extend between the insulation strips, eliminating the cutting formerly required and the former tedious operation for insulating over the main beams. Further, in large buildings, splices between ends of faced insulation batts or strips can be located over main beams and thereby concealed from below. In particular, this invention discloses means for making such splices.

BRIEF DESCRIPTION OF THE DRAWINGS

The invention is hereinafter more fully explained, reference being had to the accompanying drawings in which.

BEST MODE OF CARRYING OUT THE INVENTION

Figure 1:
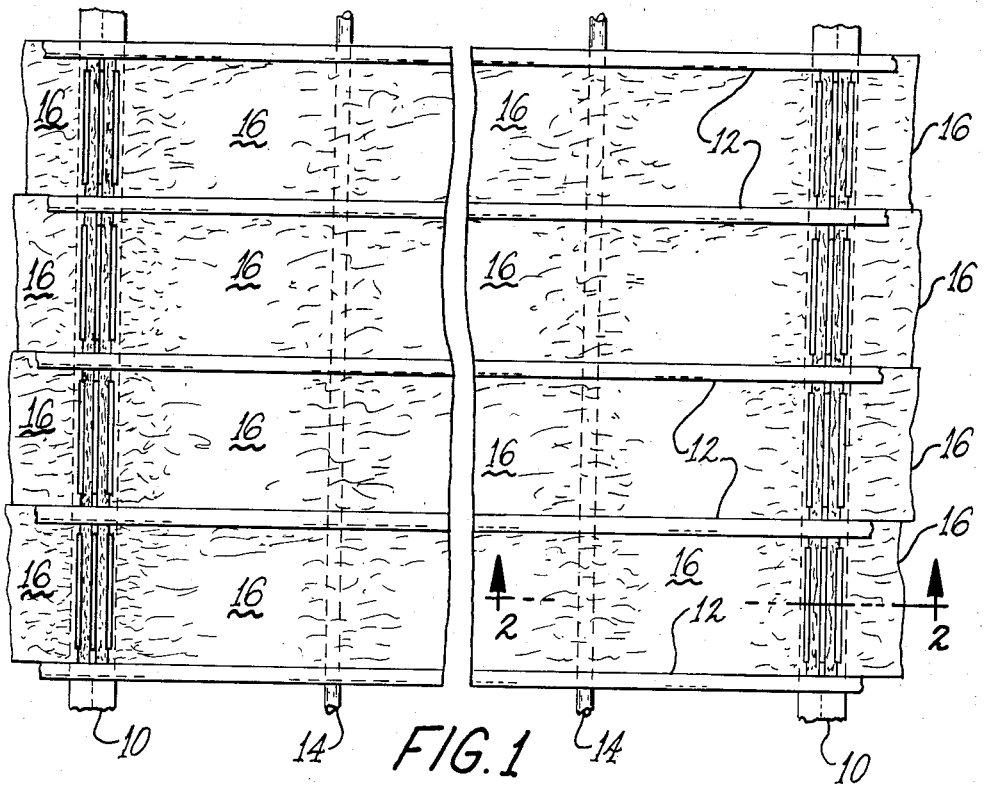
FIG. 1 is a fragmentary broken-away plan view of a metal building with roofing plates omitted to show the roof/ceiling insulation system of the invention.

With reference to the drawings, FIG. 1 shows main beams or I-beams 10 of a metal building. Supported by and crossing I-beams 10 at right angles are auxiliary beams or purlins 12. Suspended from the purlins 12 are insulation supporting tubes 14 extending parallel to the I-beams 10. Faced glass wool insulation batts 16 are strung parallel to the purlins 12 across the tubes 14 and I-beams 10.

The faced batts 16 are normally supplied in roll form, each roll normally comprising a seventy-five-foot or one-hundred-foot length of rolled, faced batt. I-beams 10 of metal buildings are normally spaced about twenty-five feet apart. Therefore, each roll of faced batt 16 normally extends across two or three I-beams 10 when unrolled. In buildings where the purlins 12 extend more than one hundred feet, faced batts 16 must be spliced together at adjacent ends, preferably on top of an I-beam 10.

FIGS. 2–5 illustrate means for splicing the faced batts. A push-on splicing member 18 is shown mounted on an upper flange of an I-beam 10 in FIG. 2. Assuming that the faced insulation batts 16 are being installed from right to left as viewed in FIG. 2, an inner roll end **16*b* of the right-hand batt 16 is first clamped to the right-hand face of the splicing member 18 by a clamping strip 20. Tension in the right-hand batt 16 thus tends to hold the splicing member 18 on the I-beam 10. An outer roll end 16*a* of the left-hand batt 16 is then clamped to the left-hand face of the splicing member 18 by another clamping strip 20** and the roll is unwound toward the left.

Figure 3:
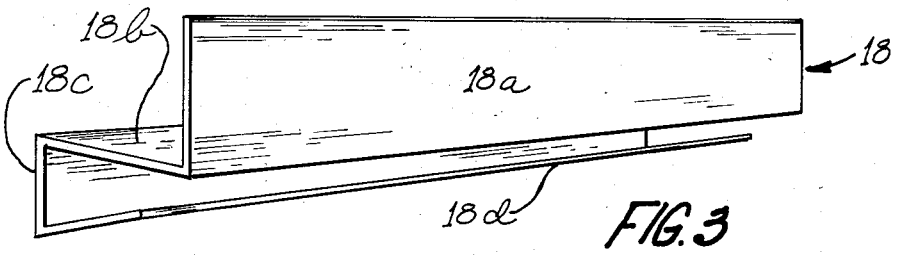
FIG. 3 is a perspective view of a push-on splicing member of the faced insulation batt splicing means of the invention.

FIG. 3 shows a sheet metal splicing member 18 in greater detail, the splicing member including a normally vertical backing portion **18*a* for the clamping strips 20, a normally horizontal support portion 18*b* supported by an upper flange of an I-beam 10 when the splicing member is installed, a normally vertical stop portion 18*c* for engaging an edge of an upper flange of the I-beam 10, and an inclined gripping portion 18*d* for gripping the lower surface of the upper flange of the I-beam 10**.

Figure 4:
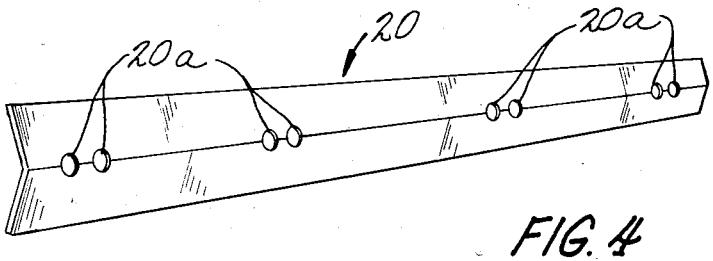
FIG. 4 is a perspective view of a clamping strip of the batt splicing means of the invention.
Figure 5:
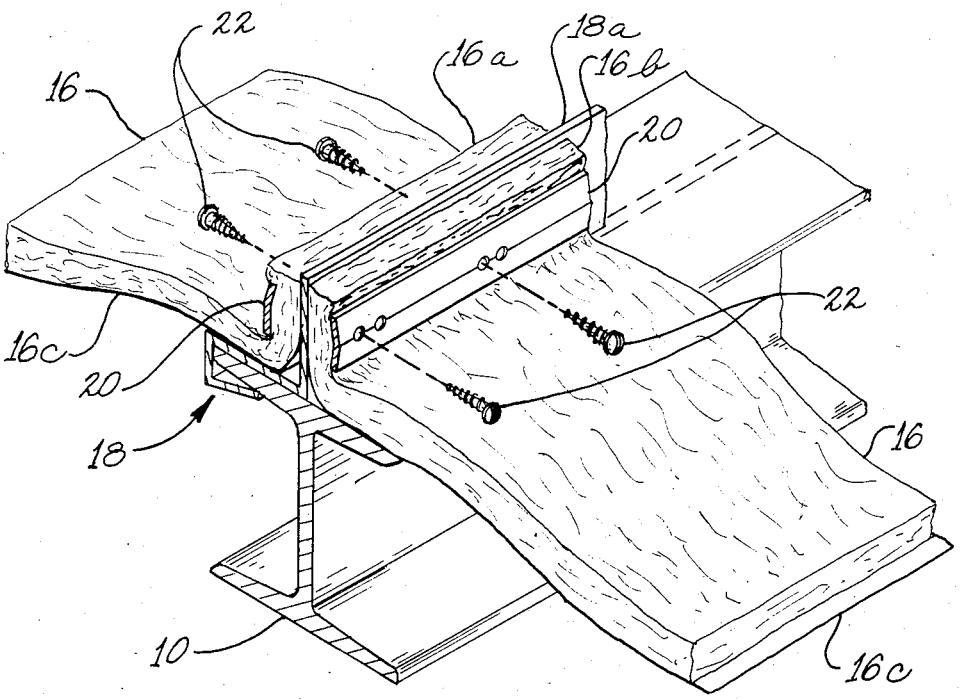
FIG. 5 is a fragmentary isometric view of an installed batt splicing means of the invention.

FIG. 4 shows a clamping strip 20 of the batt splicing means. The strip 20 is shown as though bent along a longitudinal axis to present an inwardly concave clamping surface with clamping action concentrated at the edges and is provided with four sets of two holes **20*a* for receiving self-tapping screws 22 as shown in FIG. 5. Typically, a clamping strip 20** is four feet long.

Figure 2:
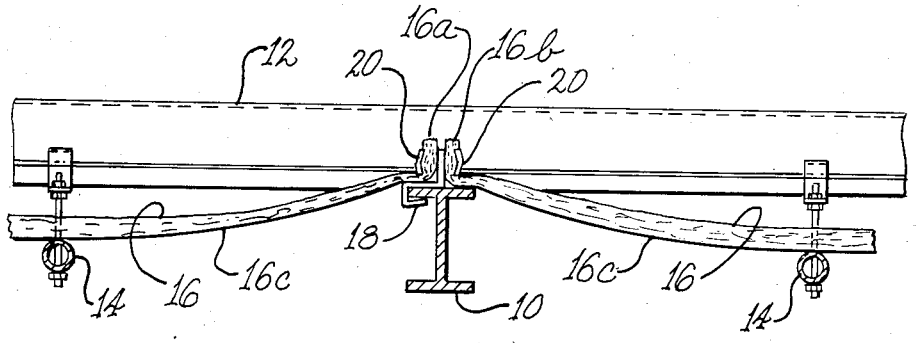
FIG. 2 is a fragmentary vertical sectional view through a main beam, taken generally along the line 2—2 of FIG. 1 and illustrating the faced insulation batt splicing means of the invention.

FIG. 5 is an enlarged fragmentary isometric view of a central portion of FIG. 2. The self-tapping screws 22 tap into the backing portion **18*a* to secure the clamping strips 20 and roll or batt ends 16*a* and 16*b* thereto. A facing 16*c* is clearly shown on one of the batts 16**.

There in an advantage to using the splicing means of the invention over merely splicing every two adjacent batt ends to each other. By securing the batt ends to a splicing member at every splice, and essentially also to the respective I-beam, each separate batt can be pulled tight, without excessive tension, to present a smooth facing for good ceiling appearance.

Various modifications may be made in the structure shown and described without departing from the scope of the invention.

I claim:

1. In a roof/ceiling insulation system for a metal building wherein a plurality of spaced parallel purlins are supported by and extend perpendicularly to a plurality of spaced parallel I-beams, spaced parallel insulation supporting tubes are suspended from the purlins and extend parallel to the main beams, and faced fibrous insulation batts are strung over the insulatin supporting tubes and main beams, means for splicing adjacent ends of two of the insulation batts together above one of the main beams and securing said ends with respect to said one main beam, said splicing means comprising a push-on splicing member mounted on an upper flange portion of said one main beam and presenting a flat backing portion extending vertically upwardly therefrom, and a pair of clamping strips respectively securing said ends of the insulation batts to opposite sides of said backing portion.

2. Means for splicing adjacent ends of two fibrous insulation batts together above an I-beam, said splicing means comprising a push-on splicing member mounted on an upper flange portion of the I-beam and presenting a flat backing portion extending vertically upwardly therefrom, and a pair of clamping strips respectively securing said ends of the insulation batts to opposite sides of said backing portion.

* * * * *